US010132542B2

(12) United States Patent
de Larminat et al.

(10) Patent No.: US 10,132,542 B2
(45) Date of Patent: Nov. 20, 2018

(54) PRESSURE CONTROL FOR REFRIGERANT SYSTEM

(71) Applicant: Johnson Controls Technology Company, Holland, MI (US)

(72) Inventors: Paul Marie de Larminat, Nantes (FR); Roger Marc Levesque, Treillieres (FR)

(73) Assignee: Johnson Controls Technology Company, Auburn Hills, MI (US)

( * ) Notice: Subject to any disclaimer, the term of this patent is extended or adjusted under 35 U.S.C. 154(b) by 518 days.

(21) Appl. No.: 14/443,292

(22) PCT Filed: Nov. 15, 2013

(86) PCT No.: PCT/US2013/070390

§ 371 (c)(1),
(2) Date: May 15, 2015

(87) PCT Pub. No.: WO2014/085111

PCT Pub. Date: Jun. 5, 2014

(65) Prior Publication Data

US 2015/0308723 A1 Oct. 29, 2015

Related U.S. Application Data

(60) Provisional application No. 61/731,286, filed on Nov. 29, 2012.

(51) Int. Cl.
*F25B 13/00* (2006.01)
*F25B 49/02* (2006.01)
(Continued)

(52) U.S. Cl.
CPC ..... *F25B 49/02* (2013.01); *F25B 13/00* (2013.01); *F25B 31/002* (2013.01);
(Continued)

(58) Field of Classification Search
CPC ..... F25B 31/004; F25B 30/00; F25B 31/002
See application file for complete search history.

(56) References Cited

U.S. PATENT DOCUMENTS 3,224,219 A * 12/1965 Boren ..... A47F 3/04 165/222
3,705,499 A 12/1972 Mount et al.
(Continued)

FOREIGN PATENT DOCUMENTS

EP 0852324 7/1998
JP 04-148158 5/1992
(Continued)

OTHER PUBLICATIONS

International Search Report & Written Opinion for International Application No. PCT/US2013/070390 dated May 2, 2014.
(Continued)

*Primary Examiner* — Ljiljana Ciric
*Assistant Examiner* — Alexis Cox
(74) *Attorney, Agent, or Firm* — Fletcher Yoder, P.C.

(57) ABSTRACT

A system includes a condenser and an evaporator. The condenser is configured to condense a working fluid, and the evaporator is configured to evaporate the working fluid. The system also includes piping that is configured to circulate the working fluid between the condenser and the evaporator. In addition, the system includes a low point configured to collect condensed working fluid. A controller is configured to selectively enable heating of the condensed working fluid collected within the low point based on a working fluid pressure of the low point.

14 Claims, 5 Drawing Sheets

(51) Int. Cl.
*F25B 31/00* (2006.01)
*F25B 43/04* (2006.01)

(52) U.S. Cl.
CPC ..... *F25B 43/043* (2013.01); *F25B 2400/01* (2013.01); *F25B 2700/19* (2013.01)

(56) References Cited

U.S. PATENT DOCUMENTS

| | | | | |
|---|---|---|---|---|
| 4,208,883 | A | 6/1980 | Stirling | |
| 5,062,277 | A * | 11/1991 | Heitmann | F01M 5/021 184/104.1 |
| 5,230,222 | A * | 7/1993 | Erbs | F25B 31/002 62/192 |
| 6,116,040 | A | 9/2000 | Stark | |
| 6,550,258 | B1 * | 4/2003 | Shoulders | F04C 28/06 62/472 |
| 6,651,451 | B2 | 11/2003 | Cho et al. | |
| 2003/0205052 | A1 * | 11/2003 | Kim | F25B 1/10 62/228.1 |
| 2009/0133435 | A1 * | 5/2009 | Toyoshima | F25B 31/004 62/473 |
| 2009/0229280 | A1 | 9/2009 | Doty et al. | |
| 2010/0251736 | A1 * | 10/2010 | Leweke | F25B 1/10 62/84 |
| 2011/0083450 | A1 * | 4/2011 | Turner | F25B 31/004 62/56 |
| 2016/0153688 | A1 * | 6/2016 | Ronk | F25B 1/047 62/84 |

FOREIGN PATENT DOCUMENTS

| | | |
|---|---|---|
| JP | 4-270865 | 9/1992 |
| JP | 2009-085568 | 4/2009 |
| KR | 10-2003-0081454 | 10/2003 |

OTHER PUBLICATIONS

JP 2015-545083 Office Action dated Jun. 14, 2016.
KR 10-2015-7017176 First Office Action dated May 32, 2016.

* cited by examiner

PRESSURE CONTROL FOR REFRIGERANT SYSTEM

BACKGROUND

The present disclosure relates generally to refrigerant systems, and more specifically, to systems and methods for pressure control within the refrigerant systems.

Refrigerants are used to transfer heat between fluids and may be employed in a variety of applications, such as heating, ventilating, air conditioning, and refrigeration (HVAC&R) systems, heat pumps, or power generation in Organic Rankine Cycles (ORC). The refrigerant is typically transported within a refrigerant piping system, which includes pipes, pipe fittings, valves, and the like. The refrigerant piping system transports the refrigerant between various vessels and equipment within the HVAC&R system, such as compressors, turbines, pumps, evaporators, condensers, and the like. It is now recognized that a leakage in the refrigerant piping system, the vessels, or the equipment may cause air to enter the HVAC&R system, thereby reducing the efficiency and operability of the HVAC&R system if such leakage occurs in a part of the refrigerant circuit at a pressure below atmospheric pressure. This leakage may occur in heat pumps or ORC systems, particularly when the system is not operating. In addition, moisture from the air may corrode the HVAC&R system, exacerbating the leakage.

DETAILED DESCRIPTION

The present disclosure is directed to systems and methods for pressure control of refrigerant systems. As used herein, the term "refrigerant system" includes any thermodynamic system that uses a working fluid (e.g., a refrigerant) to absorb and/or transfer energy. Accordingly, a refrigeration system may be an HVAC&R system, a heat pump system, an ORC system, or the like.

As noted earlier, leakages within the refrigerant piping system, the vessels, or the equipment of a refrigerant system may result in air ingress, particularly when refrigerant pressure is less than the ambient pressure. Air ingress reduces the efficiency and operability of the refrigerant system and may result in corrosion of the refrigerant piping system, the vessels, and/or the equipment. In addition, when air enters the refrigerant circuit, it may be desirable to purge the air out of the refrigerant system. Unfortunately, purging the air may induce undesired leakage of the refrigerant out of the refrigerant system.

It is now recognized that the refrigerant pressure may be controlled to reduce the possibility of air ingress into the refrigerant system. That is, the refrigerant pressure may be maintained above the ambient pressure, thereby reducing the driving force for air ingress into the refrigerant system. In particular, the refrigerant system includes one or more low points designed to collect liquid refrigerant. For example, gravity may pull the liquid refrigerant towards the one or more low points of the refrigerant system. A heating source may be employed to heat the liquid refrigerant collected within the one or more low points, thereby maintaining the refrigerant pressure above the ambient pressure and reducing the possibility of air ingress into the refrigerant system.

Figure 1:
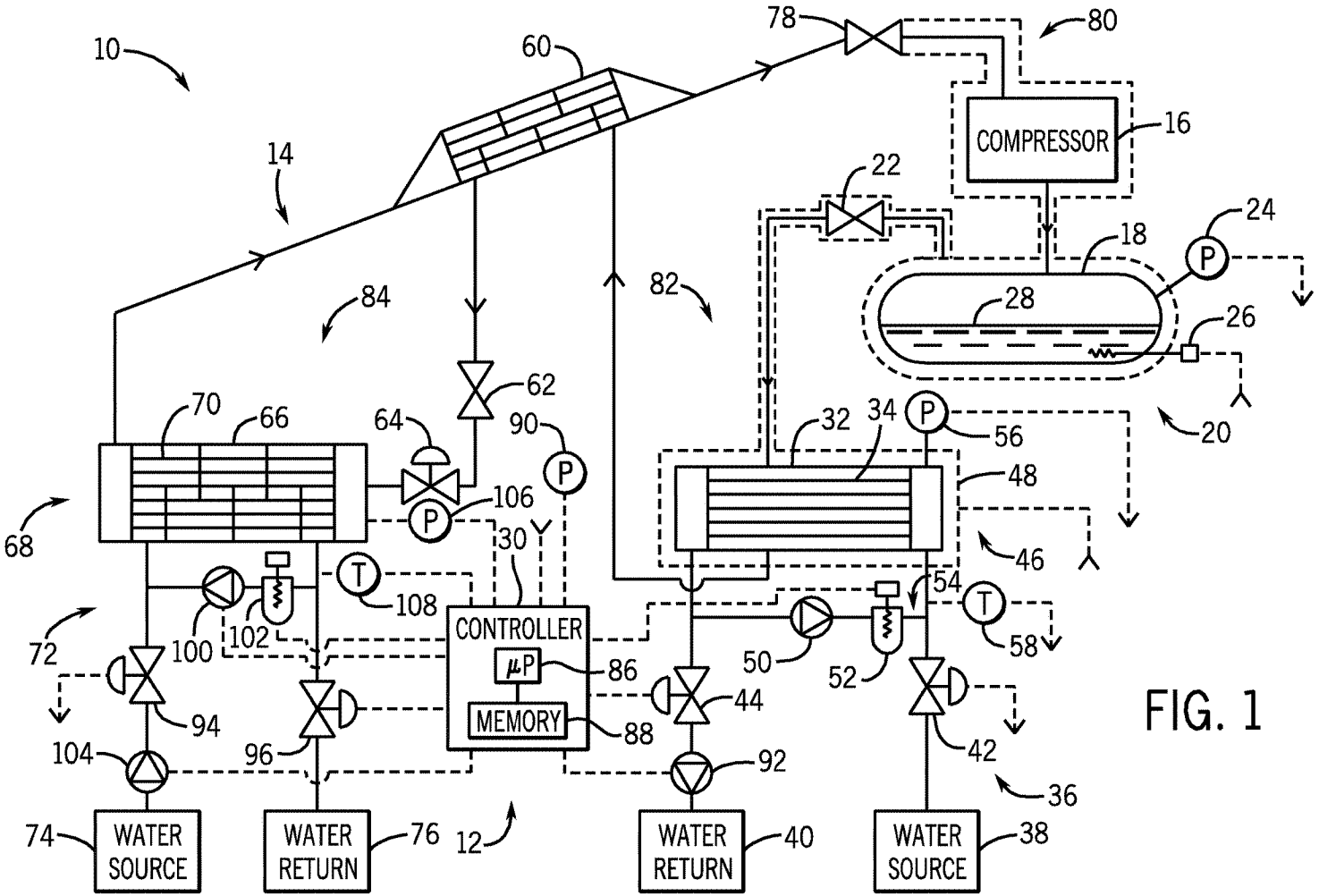
FIG. 1 is a schematic diagram of an embodiment of a heat pump system having a refrigerant piping system and a pressure control system, in accordance with aspects of the present techniques.

Turning now to the figures, FIG. 1 illustrates an embodiment of an refrigerant system (e.g., a heat pump system 10) with a pressure control system 12 configured to reduce the possibility of air ingress into the heat pump system 10. The refrigerant system includes a compressor 16 (e.g., a screw compressor) and other equipment associated with operation of the compressor 16, such as an oil separator 18 and/or a superheater 60. It should be noted that the heat pump system 10 is given by way of example, and the present disclosure may be applied to a variety of refrigerant systems, such as organic Rankine cycle (ORC) systems, chillers, and the like. In addition, components of the heat pump system 10 may be implementation-specific. That is, the flow configurations and types of heat exchangers, the numbers and types of compressors, pumps, valves, and the like, may vary widely among embodiments.

The heat pump system 10 includes a refrigerant piping system 14, which transports a working fluid (e.g., a refrigerant, such as R-245fa or R-236fa) between the various components of the heat pump system 10. For example, the refrigerant enters the compressor 16, which compresses and pressurizes the refrigerant. The pressurized refrigerant then flows to the oil separator 18, which separates the refrigerant from lubrication oil of the compressor 16. It should be noted that certain embodiments of the heat pump system 10 may not include the compressor 16. For example, an organic Rankine cycle (ORC) system may employ a pump instead of the compressor 16 to pressurize and transport liquid refrigerant. In addition, certain embodiments may not employ the oil separator 18. In other words, the refrigerant may flow from the outlet of the compressor 16 directly to a valve 22 or a condenser 32 instead of through the oil separator 18.

As illustrated, the oil separator 18 is disposed at a low point 20 of the heat pump system 10. That is, the oil separator 18 is disposed at a local minimum elevation between the compressor 16 and the valve 22. Thus, liquid refrigerant may drain into the oil separator 18 by gravity flow, particularly when the heat pump system is not operating. As discussed earlier, it may be desirable to monitor and control the pressure of the refrigerant within the low point 20 to reduce the possibility of air ingress into the heat pump system 10.

After the lubrication oil is separated out, the refrigerant flows through the valve 22 to the condenser 32, where the refrigerant is condensed into a liquid phase. The condenser 32 is also disposed at a low point 46 of the heat pump system 10 between the valve 22 and a superheater 60. A controller 30 may be employed to control the heating of liquid refrigerant that collects within the condenser 32 (i.e., low point 46), when desired. As shown, the condenser 32 includes a bundle of tubes 34, which are coupled to a coolant piping system 36. The coolant piping system 36 transports a coolant (e.g., water) from a water source 38 to a water return 40. For example, water from the water source 38 may flow through the tubes 34, where the water absorbs heat from the refrigerant, thereby causing the refrigerant to condense into a liquid phase. Subsequently, the warmed water may flow to the water return 40, where the warmed water is routed to downstream applications, such as cooling towers and the like.

The condensed refrigerant exits the condenser 32 and flows through the superheater 60, a valve 62, and a thermal expansion valve 64, which is a metering device. The expansion valve 64 meters the flow of condensed refrigerant into an evaporator 66, which evaporates the refrigerant into a vapor phase. However, certain embodiments may not include the thermal expansion valve 64. It may be desirable for refrigerant to freely flow from the condenser 32 to the evaporator 66. For example, ORC systems may include a turbine disposed between the evaporator 66 and the condenser 32, without the thermal expansion valve 64.

As shown, the evaporator 66 is also disposed at a low point 68 of the heat pump system 10 between the expansion valve 64 and the superheater 60 or shut-off valve 78. As will be appreciated, during normal operation of the heat pump system 10, the operating conditions of the evaporator 66 may maintain the refrigerant in a vapor phase. However, when the heat pump system 10 is not operational, the temperature of the refrigerant may gradually decrease, resulting in condensation of the refrigerant into a liquid phase. The liquid refrigerant may drain by gravity flow into the evaporator 66 and the low point 68. Again, it may be desirable to monitor and control the pressure of the refrigerant within the low point 68 to reduce the possibility of air ingress into the heat pump system 10, particularly when the heat pump system 10 is not operational (e.g., for a brief period due to a process upset or for a longer period during a shutdown).

As shown, the evaporator 66 includes a bundle of tubes 70, which are coupled to an additional coolant piping system 72. The coolant piping system 72 of the evaporator 66 is similar to the coolant piping system 36 of the condenser 32. That is, the coolant piping system 72 transports a coolant (e.g., water) from a water source 74 through the tubes 70, where the water expels heat to the refrigerant, thereby causing the refrigerant to evaporate. The cooled water then flows to a water return 76, where the cooled water is routed to downstream applications, such as air conditioners and the like.

The vaporized refrigerant from the evaporator 66 flows into the superheater 60, where the vaporized refrigerant is heated by the condensed refrigerant from the condenser 32. The superheated refrigerant then flows through a suction valve 78 to the compressor 16, where the heat pump cycle may essentially begin again. It should be noted that certain embodiments of the heat pump system 10 may not include the superheater 60. That is, evaporated refrigerant may flow from an outlet of the evaporator 66 directly to the suction valve 78 or the compressor 16 rather than through the superheater 60.

As illustrated, the valves 22, 62, and 78 may be used to divide the heat pump system 10 into three sections 80, 82, and 84. Each of the sections 80, 82, and 84 is designed with at least one low point (e.g., low points 20, 46, and 68) to collect liquid refrigerant by gravity flow. Although the oil separator 18, the condenser 32, and the evaporator 66 are illustrated as the respective low points 20, 46, and 68, the heat pump system 10 may be designed with low points in other locations, such as the superheater 60, the compressor 16, or other designated liquid pockets within the heat pump system 10. For example, the refrigerant piping system 14 may include a u-shaped pocket designed to collect liquid refrigerant by gravity flow. The controller 30 may be used to control the heating of the liquid refrigerant within the low points 20, 46, and 68.

As illustrated, the controller 30 includes various components to implement the logic to heat the liquid refrigerant. In particular, the controller 30 includes one or more processors 86 and/or other data processing circuitry, such as memory 88, to execute instructions to enable selective heating of the liquid refrigerant collected within the low points 20, 46, and 68. These instructions may be encoded in software programs that may be executed by the one or more processors 86. Further, the instructions may be stored in a tangible, non-transitory (i.e., not merely a signal), computer-readable medium, such as the memory 88.

In certain embodiments, various operating parameters and thresholds may be encoded and stored within the memory 88 to be later accessed by the one or more processors 88. For example, an ambient pressure sensor 90 may detect an ambient pressure around the heat pump system 10. The processor 86 may calculate a threshold pressure based on the ambient pressure, and the threshold pressure may be stored within the memory 88 for later use in order to heat the low points 20, 46, and 68, as will be discussed in greater detail below. The controller 30 may control the heating of the liquid refrigerant within each of the sections 80, 82, and 84 independently. It should be noted that certain embodiments may not include the ambient pressure sensor 90. As will be appreciated, fluctuations of the atmospheric pressure are small compared to the pressure fluctuations within the refrigerant system. Accordingly, the atmospheric pressure may be assumed to be constant, thereby enabling the controller 30 to operate without the ambient pressure sensor 90. However, in certain embodiments, such as heat pump systems at high elevations, the ambient pressure sensor 90 may be desirable, and the pressure threshold may be adjusted accordingly.

Figure 2:
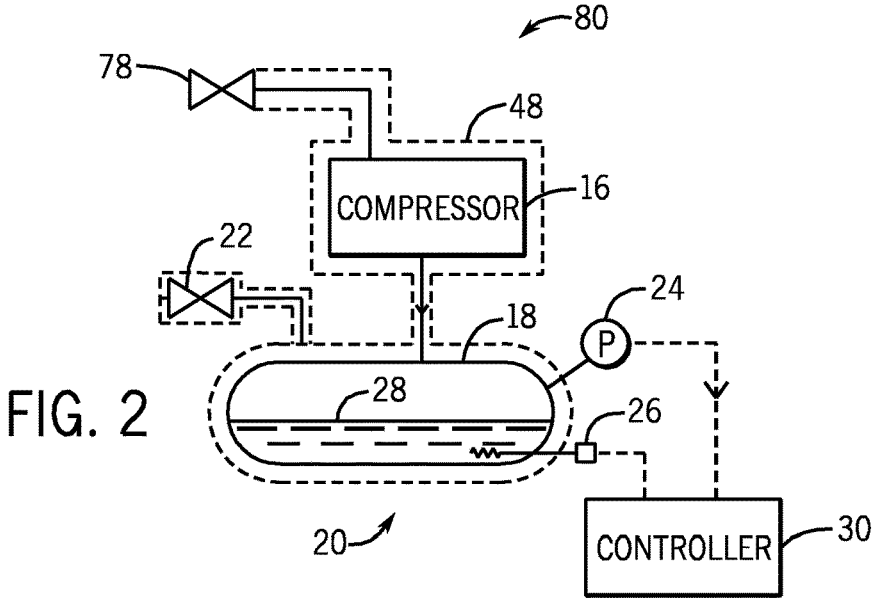
FIG. 2 is a schematic diagram of an embodiment of a first section of the heat pump system of FIG. 1, in accordance with aspects of the present techniques.

FIG. 2 illustrates the section 80 of the heat pump system 10 between the valves 78 and 22. The valves 78 and 22 may be closed to isolate the section 80 from the remainder of the heat pump system 10. As explained earlier, liquid refrigerant may collect within the oil separator 18 (i.e. low point 20) and become diluted in the oil, particularly when the heat pump system 10 is not operational. It may be desirable to heat the blend of oil and liquid refrigerant that collects within the oil separator 18 to reduce the possibility of air ingress into the section 80. Accordingly, a heat source (e.g., an electrical heater or heating coil 26) is coupled to the oil separator 18. As shown, the heating coil 26 is submerged within a pool 28 of mixed oil and liquid refrigerant, and the heating coil 26 may supply heat directly to this mixture. In certain embodiments, additional or alternative heating sources may be used to heat the mixture. For example, heat tracing 48 (e.g., steam tracing or electrical tracing) that is externally coupled to the oil separator 18 may heat the oil separator 18, thereby heating the liquid refrigerant within the oil separator 18.

The controller 30 may selectively enable heating of the oil separator 18 using the heating coil 26, the heat tracing 48, or both, based on an operating condition (e.g., pressure) of the section 80. As illustrated, a pressure sensor 24 is coupled to the oil separator 18. The pressure sensor 24 detects a pressure within the oil separator 18 as an indication of the refrigerant pressure. In a presently contemplated embodiment, the controller 30 may compare the detected pressure from the pressure sensor 24 with a threshold pressure stored within the memory 88 to determine if heating the mixed oil and liquid refrigerant is desirable. For example, when the detected pressure is below the threshold pressure, the controller 30 may selectively enable the heating coil 26, the heat tracing 48, or both, to heat the mixture of refrigerant and oil to reduce the possibility or air ingress into the section 80. In certain embodiments, the threshold pressure may be based at least in part on the ambient pressure, which may be assumed constant or may be detected by the ambient pressure sensor 90. For example, the threshold pressure may be between approximately 100 to 300, 110 to 250, 150 to 200 percent of the ambient pressure, and all subranges therebetween.

The controller 30 may implement various logic to heat the mixture of liquid refrigerant and oil, in addition to the pressure-based control algorithm described above. For example, the controller 30 may selectively enable the heating coil 26, the heat tracing 48, or both, based on the temperature of the refrigerant, the amount of time the heat pump system 10 has been non-operational, or a combination thereof. The temperature-based and time-based control algorithms will be described in greater detail with respect to FIGS. 3 and 4.

Figure 3A:
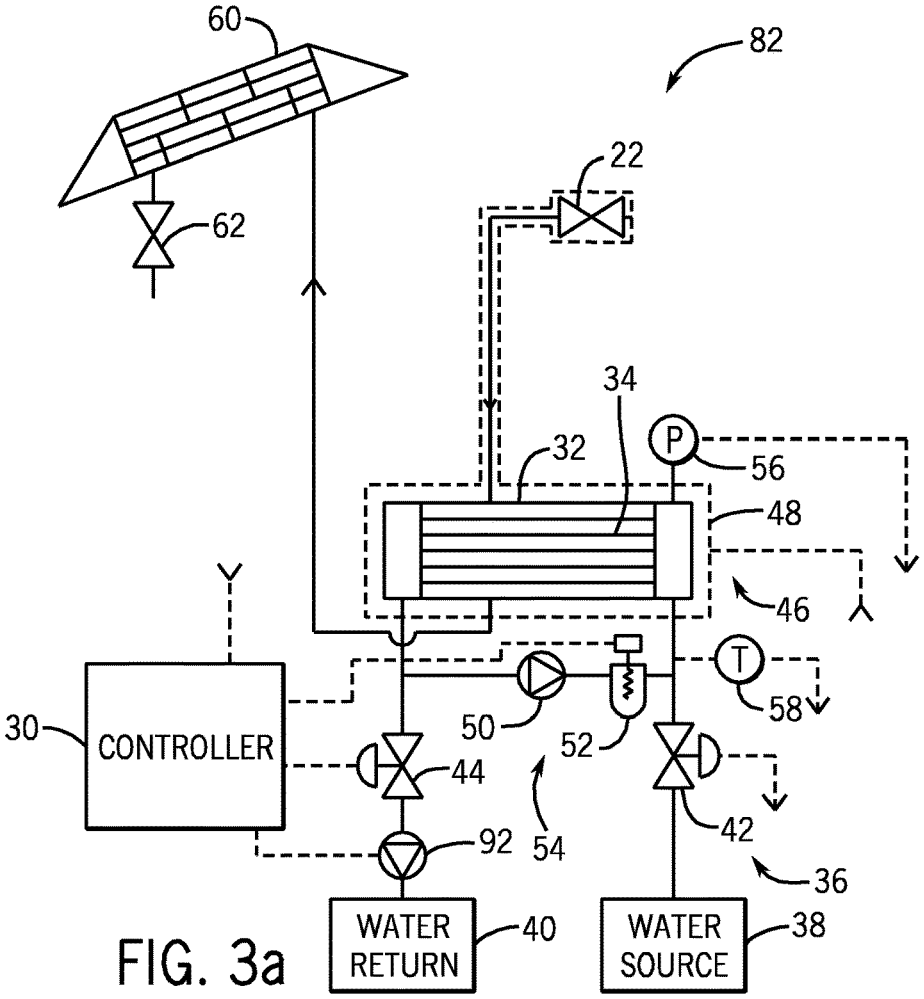
FIG. 3*a* is a schematic diagram of an embodiment of a second section of the heat pump system of FIG. 1, in accordance with aspects of the present techniques.
Figure 3B:
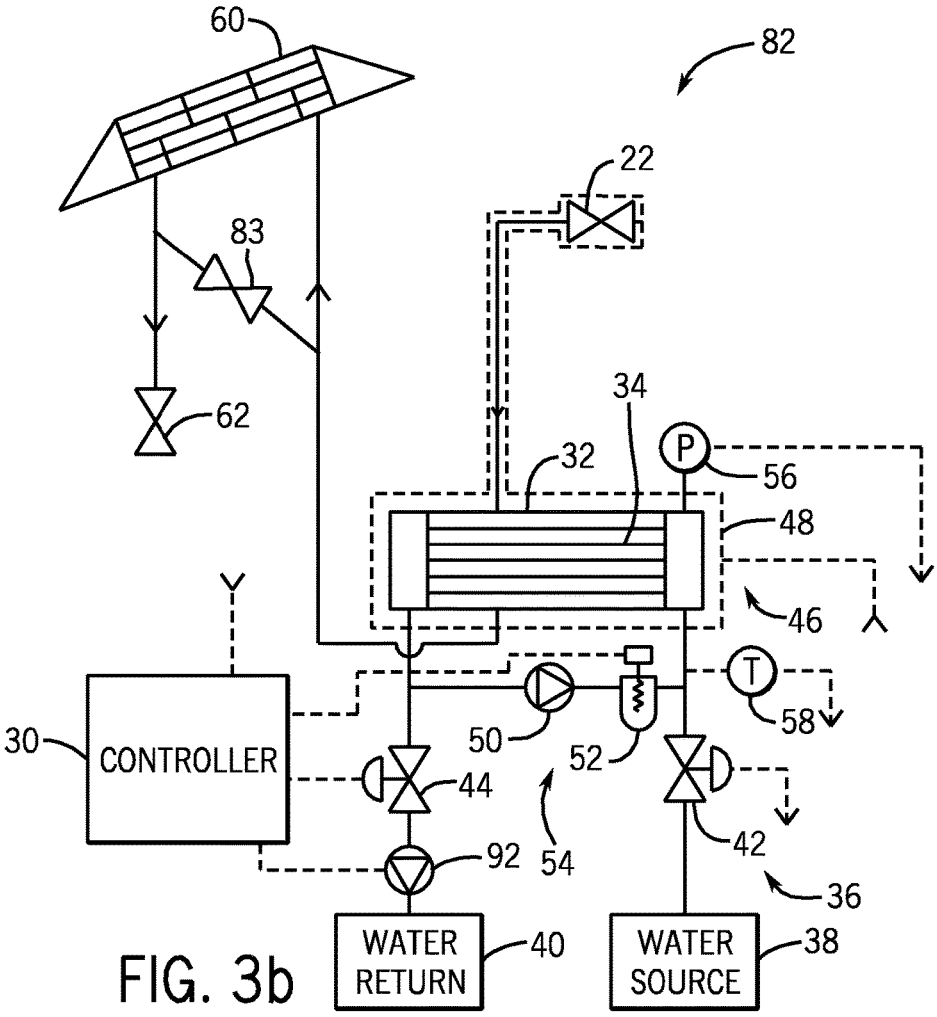
FIG. 3*b* is a schematic diagram of an embodiment of the second section of the heat pump system of FIG. 1, in accordance with aspects of the present techniques.

FIGS. 3*a* and 3*b* illustrate the section 82 between the valves 22 and 62. The valves 22 and 62 may be closed to isolate the section 82 from the remainder of the heat pump system 10. In certain embodiments, the valve 62 may occupy a lower elevation relative to the valve 62 in FIG. 3*a* (as illustrated in FIG. 3*b*). The elevation may affect the amount of accumulated refrigerant in the superheater 60 and the piping system when the valve 62 is closed. Additionally or alternatively, a bypass valve 83 may enable refrigerant to bypass the superheater 60, which is also illustrated in FIG. 3*b*.

Again, because the condenser 32 is disposed at the low point 46, liquid refrigerant may collect within the condenser 32 by gravity flow. However, in certain embodiments, the refrigerant from the superheater 60 may not drain to the condenser 32 due to a "neck" effect. For example, the superheater 60 may be a shell and tube heat exchanger with one or more baffles that may hold the condensed refrigerant when the heat pump system 10 is not operating. Additionally or alternatively, a static head of liquid (e.g., condensed refrigerant) may maintain a liquid level in the superheater 60. Nevertheless, the condenser 32 generally contains a sufficient level of liquid to enable pressure control within the heat pump system 10, as discussed below.

During normal operation of the heat pump system 10, the pressure of the liquid refrigerant is generally sufficiently high (e.g., greater than the ambient pressure) to reduce the possibility of air ingress into the heat pump system 10. However, when the heat pump system 10 is not operational, the temperature and pressure of the liquid refrigerant may gradually decrease, particularly in environments with low ambient temperatures. Accordingly, it may be desirable to heat the liquid refrigerant that collects within the condenser 32 to reduce the possibility of air ingress into the section 82.

The heat may be provided from a variety of heat sources. For example, the heat tracing 48 that is externally coupled to the condenser 32 may provide the heat to the condenser 32, thereby heating the liquid refrigerant within the condenser 32. Additionally or alternatively, water from the coolant piping system 36 may heat the liquid refrigerant within the condenser 32 (i.e. low point 46). For example, the water may flow from the water source 38 through the tubes 34, releasing heat to the liquid refrigerant. In other words, the heat source may include a heat transfer fluid (e.g., water).

As illustrated, the coolant piping system 36 also includes control valves 42 and 44, which are disposed along the water flow path between the water source 38 and the water return 40. The control valves 42 and 44 may selectively enable or block the flow of water to the condenser 32. For example, it may be desirable close the control valves 42 and 44 in order to perform maintenance on the tubes 34 of the condenser 32. On the other hand, the controller 30 may open the control valves 42 and 44 to enable water to flow to the condenser 32. In certain embodiments, the controller 30 may start up a pump 92 to increase the flow of water through the tubes of the condenser 34, thereby increasing the rate at which the liquid refrigerant is heated.

In a presently contemplated embodiment, it may be desirable to increase the temperature of the water within the coolant piping system 36, which enables faster heating of the liquid refrigerant within the low point 46. To this end, the coolant piping system includes a pump 50 and a heat source (e.g., electrical heater 52). The electrical heater 52 warms the water, and the pump 50 transports the water through the tubes 34 of the condenser 32. In certain configurations, the controller 30 may close the control valves 42 and 44, enabling the water to re-circulate through a continuous loop 54 between the electrical heater 52 and the tubes 34. The continuous recirculation and heating of the water may increase the efficiency of the coolant piping loop 36 and reduce the water consumption of the heat pump system 10.

A pressure sensor 56 is coupled to the condenser 32, so that the controller 30 may implement the pressure-based control algorithm described previously. That is, the controller 30 may selectively enable the heat tracing 48, the coolant piping system 36, or both, to heat the refrigerant within the condenser based on the pressure detected by the pressure sensor 56. As shown, the controller is communicatively coupled to the pressure sensor 56, as well as the heat tracing 48, the pump 50, and the electrical heater 52. It should be noted that in other embodiments, additional or alternative sources (e.g., heating coils) may be used.

The controller 30 may implement a time-based control algorithm in addition to the pressure-based control algorithm described above. For example, if the heat pump system 10 has been non-operational for a time period, the controller 30 may enable the water from the coolant piping system 36 to heat the liquid refrigerant within the condenser 32. In particular, the controller 30 may open the control valves 42 and 44 and start up the pump 92 to enable water to flow through the tubes 34 of the condenser 32. The water flow may increase the temperature and pressure of the liquid refrigerant. However, after a time delay, if the refrigerant pressure is still below the threshold pressure, the controller 30 may enable re-circulation of the water through the continuous loop 54, as described above. That is, the controller 30 may close the control valves 42 and 44 and subsequently enable the electrical heater 52 and the pump 50. The electrical heater 52 increases the temperature of the water, thereby increasing the rate at which the liquid refrigerant is heated.

In certain embodiments, the controller 30 may enable re-circulation of the water through the continuous loop 54 based on a temperature of the water (i.e., temperature-based control). As illustrated, a temperature sensor 58 is coupled to the coolant piping system 36. The temperature sensor 58 detects a temperature of the water within the continuous loop 54 of the coolant piping system 36. If the detected temperature is below a threshold temperature, it may be desirable to increase the water temperature to heat the liquid refrigerant more quickly. Thus, the controller 30 may enable re-circulation of the water through the continuous loop 54 when the detected temperature is below the threshold temperature. The threshold temperature may be based at least in part on a saturation temperature of the liquid refrigerant.

Figure 4:
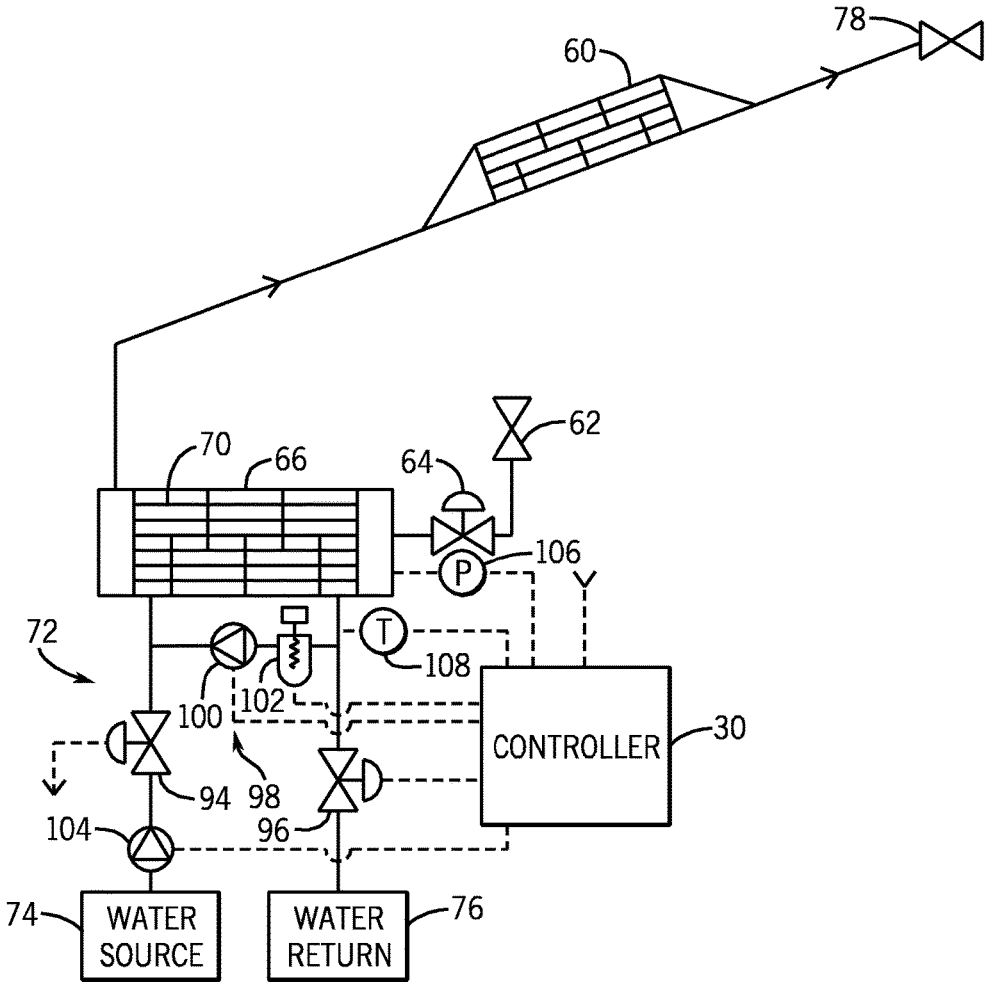
FIG. 4 is a schematic diagram of an embodiment of a third section of the heat pump system of FIG. 1, in accordance with aspects of the present techniques.

FIG. 4 illustrates the section 84 between the valves 62 and 78, as well as the coolant piping system 72. The coolant piping system 72 of the evaporator 66 is similar to the coolant piping system 36 of the condenser 32. That is, the coolant piping system 72 includes control valves 94 and 96 to selectively block or enable water flow through the tubes 70 of the evaporator 66. In addition, the coolant piping system 72 includes a re-circulation loop 98 with a pump 100 and an electrical heater 102. Further, the coolant piping system 72 includes a pump 104, a pressure sensor 106, and a temperature sensor 108 to implement the pressure-based, temperature-based, or time-based control algorithms, or any combination thereof, as described previously. It should be noted that the pressure thresholds, temperature thresholds, or other parameters of the control algorithms may vary between the coolant piping systems 36 and 72. For example, the pressure threshold of the coolant piping system 72 may be higher than the pressure threshold of the coolant piping system 36.

Figure 5:
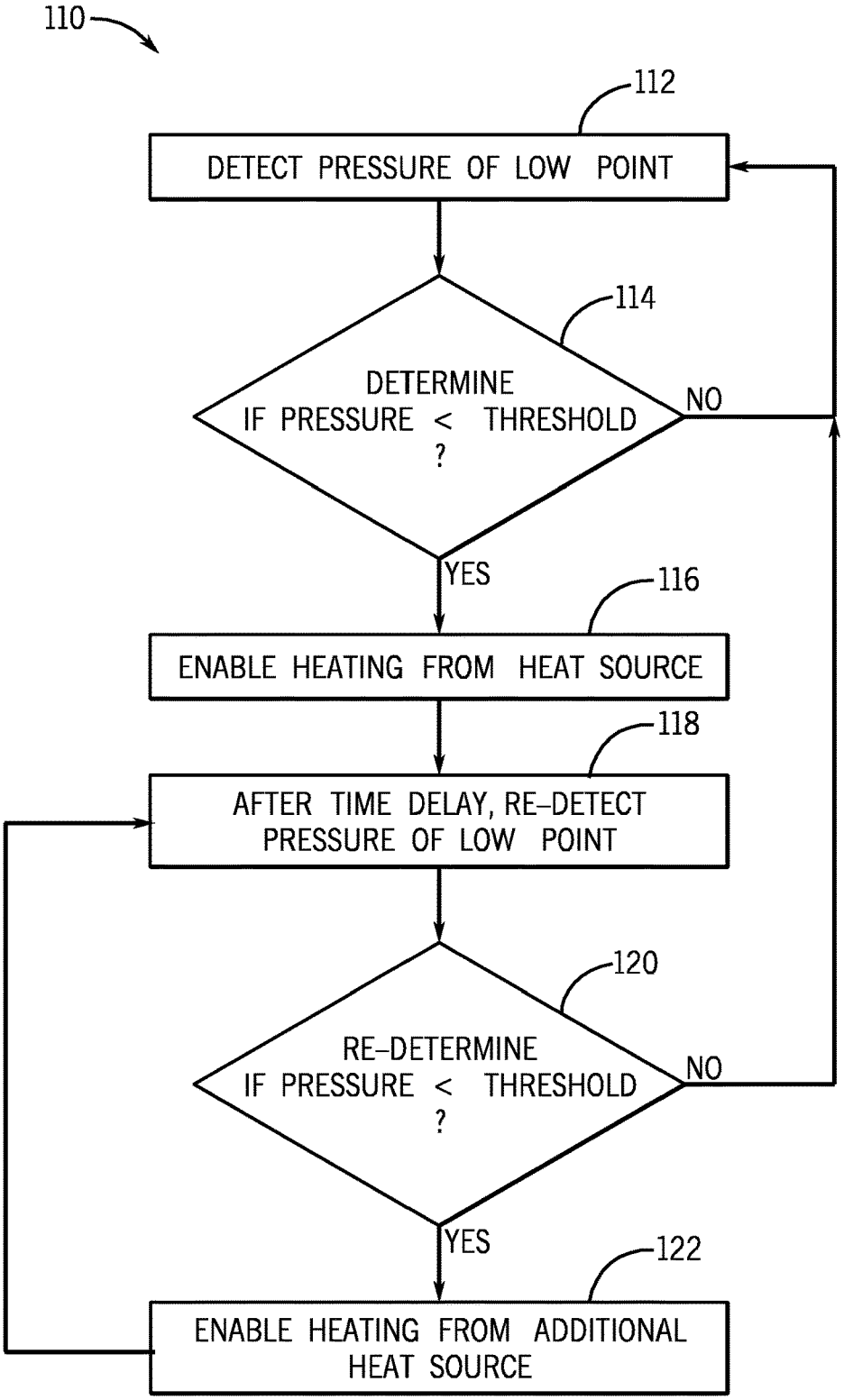
FIG. 5 is an embodiment of a flowchart of a method to control the pressure within the refrigerant piping system and the heat pump sections of FIGS. 2-4, in accordance with aspects of the present techniques.

FIG. 5 illustrates an embodiment of a method 110 to control the pressure within the low points 20, 46, 68 of the heat pump system 10. The pressure sensors 24, 56, and 106 may detect (block 112) a pressure of the respective low points 20, 46, and 68. The controller 30 may determine (block 114) if the detected pressure is less than a threshold pressure. In certain embodiments, the threshold pressure may be based on an assumed (e.g., constant) ambient pressure or an ambient pressure detected by the ambient pressure sensor 90. In addition, the threshold pressure may be stored within the memory 88 of the controller 30. When the detected pressure is less than the threshold pressure, the controller 30 may enable (block 116) heating of the liquid refrigerant collected within the low points 20, 46, 68 using a heat source (e.g., water from coolant piping systems 36 and 72, heat tracing 48, heating coils 26, or any combination thereof). After a time delay, the pressure sensors 24, 56, and 106 may re-detect (block 118) the pressure of the respective low points. The controller 30 may then re-determine (block 120) if the detected pressure is less than the threshold pressure. If the detected pressure is still less than the threshold pressure, the controller 30 may enable (block 122) heating from an additional heat source (e.g., electrical heaters 52 and 102). If the detected pressure is greater than or equal to the threshold pressure, the process may essentially begin again.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A refrigerant system comprising:

a condenser configured to condense a working fluid;

an evaporator configured to evaporate the working fluid;

piping configured to circulate the working fluid between the condenser and the evaporator;

a low point of the refrigerant system, the low point configured to collect condensed working fluid;

a heat source configured to heat the working fluid within the low point; and a controller configured to;

receive feedback indicative of the working fluid pressure at the low point, reference the ambient pressure, compare the feedback to a threshold pressure that is calculated based on the ambient pressure, selectively activate the heat source to heat the condensed working fluid collected within the low point in response to the working fluid pressure being below the threshold pressure;

wherein the refrigerant system comprises a first section and a second section separated by a flow control device, wherein the first section comprises the low point, and wherein the first section and the second section are arranged in a series with respect to a flow of the working fluid.

2. The system of claim 1 wherein the threshold pressure is between 100 and 300 percent of the ambient pressure.

3. The system of claim 1, comprising:

a compressor configured to receive the working fluid from the evaporator and to compress the working fluid; and a metering device configured to receive the working fluid from the condenser and to meter a flow of the working fluid into the evaporator.

4. The system of claim 3, comprising:

a superheater configured to exchange heat between the working fluid exiting the condenser and the working fluid exiting the evaporator; and an oil separator configured to separate a lubricating oil from the working fluid.

5. The system of claim 4, wherein at least one of the evaporator, the oil separator, the superheater, the compressor, and a liquid pocket of the piping comprises the low point.

6. The system of claim 1, comprising:

a pressure sensor configured to provide the feedback to the controller indicative of the working fluid pressure at the low point.

7. The system of claim 1, wherein the heat source comprises at least one of an electrical heater and heat tracing, coupled to the low point.

8. The system of claim 1, wherein the heat source comprises a heat transfer fluid configured to exchange heat with the working fluid within the low point.

9. The system of claim 8, comprising:

an additional heat source configured to heat the working fluid within the low point; and a temperature sensor configured to measure a temperature of the heat transfer fluid, wherein the controller is configured to selectively activate the heat source, the additional heat source, or both, to heat the condensed working fluid based at least in part on the working fluid pressure at the low point and the temperature of the heat transfer fluid.

10. The system of claim 9, wherein the additional heat source comprises at least one of an electrical heater and heat tracing configured to increase a temperature of the heat transfer fluid.

11. The system of claim 10, wherein the controller is configured to adjust a valve to enable the heat transfer fluid to exchange heat with the working fluid within the low point when the refrigerant system is not operational for a time period, and the controller is configured to enable the additional heat source to increase the temperature of the heat transfer fluid after a time delay.

12. The system of claim 1, wherein the flow control device comprises one or more valves, wherein the second section comprises an additional low point to collect the condensed working fluid, and wherein the controller is configured to selectively activate heating of the heat source based on the working fluid pressure at the low point and an additional working fluid pressure at the additional low point.

13. The system of claim 1, wherein the controller is configured to reference the ambient pressure from an ambient pressure sensor.

14. The system of claim 1, wherein the controller is configured to reference the ambient pressure stored in memory of the controller.

* * * * *